US007902486B2

(12) United States Patent
Shindo

(10) Patent No.: US 7,902,486 B2
(45) Date of Patent: Mar. 8, 2011

(54) AIR CONDITIONER, METHOD OF CONTROLLING THE SAME, TEMPERATURE SETTING DEVICE AND METHOD OF CONTROLLING THE SAME

(75) Inventor: Akira Shindo, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 1153 days.

(21) Appl. No.: 11/368,103

(22) Filed: Mar. 3, 2006

(65) Prior Publication Data

US 2006/0201930 A1 Sep. 14, 2006

(30) Foreign Application Priority Data

Mar. 11, 2005 (JP) ..... 2005-068547

(51) Int. Cl.
*H05B 1/02* (2006.01)

(52) U.S. Cl. ..... 219/497; 219/491; 219/494; 219/508; 374/101

(58) Field of Classification Search ..... 219/491, 219/494, 497, 506, 510, 508; 374/101, 102
See application file for complete search history.

(56) References Cited

U.S. PATENT DOCUMENTS 5,765,383 A 6/1998 Inoue et al.

FOREIGN PATENT DOCUMENTS

| | | |
|---|---|---|
| JP | 59125347 | 7/1984 |
| JP | 01252097 | 10/1989 |
| JP | 7-305882 A | 11/1995 |
| JP | 2005/070844 | 3/2005 |

*Primary Examiner* — Mark H Paschall
(74) *Attorney, Agent, or Firm* — Westerman, Hattori, Daniels & Adrian, LLP

(57) ABSTRACT

An operating device provided to equipment such as an indoor unit of an air conditioner is equipped with an analog operating member for setting a set temperature of the equipment and outputting an indication value that is associated with the set temperature and continuously varies in accordance with an operation of the analog operating member, and a set temperature adjusting unit for changing a variable range of the set temperature corresponding to a variable range of the indication value on the basis of at least one of an operation mode of the equipment and the type of the equipment.

11 Claims, 6 Drawing Sheets

FIG. 4

D1

| OPERATION MODE | UPPER LIMIT VALUE OF OPERABLE TEMPERATURE RANGE | LOWER LIMIT VALUE OF OPERABLE TEMPERATURE RANGE |
|---|---|---|
| COOLING OPERATION | A1 | B1 |
| HEATING OPERATION | A2 | B2 |
| DRY OPERATION | A3 | B3 |
| COOLING/HEATING AUTOMATIC OPERATION | A4 | B4 |

FIG. 7

| TYPE OF INDOOR UNIT | OPERATION MODE | UPPER LIMIT VALUE OF OPERABLE TEMPERATURE RANGE | LOWER LIMIT VALUE OF OPERABLE TEMPERATURE RANGE |
|---|---|---|---|
| FOUR-WAY CASSETTE | COOLING OPERATION | A1 | B1 |
| | HEATING OPERATION | A2 | B2 |
| | DRY OPERATION | A3 | B3 |
| | COOLING/HEATING AUTOMATIC OPERATION | A4 | B4 |
| BUILT-IN CASSETTE | COOLING OPERATION | A5 | B5 |
| | HEATING OPERATION | A6 | B6 |
| | DRY OPERATION | A7 | B7 |
| | COOLING/HEATING AUTOMATIC OPERATION | A8 | B8 |
| ⋮ | ⋮ | ⋮ | ⋮ |

AIR CONDITIONER, METHOD OF CONTROLLING THE SAME, TEMPERATURE SETTING DEVICE AND METHOD OF CONTROLLING THE SAME

BACKGROUND OF THE INVENTION

1. Field of the Invention

The present invention relates to an air conditioner that is equipped with an operating device having an analog operating member and sets a set temperature of an indoor unit in accordance with an operation of the analog operating member, a method of controlling the air conditioner, a temperature setting device for the air conditioner, and a method of controlling the temperature setting device.

2. Description of the Related Art

There is known an air conditioner for air-conditioning each guest room of a hotel or the like that is equipped with an operating device having a temperature adjusting dial, detects an analog value (for example, a voltage value) continuously-variable in accordance with an operation of the temperature adjusting dial and sets the set temperature of a room to be air-conditioned on the basis of the thus-detected analog value (JP-A-7-305882, for example). In this type of air conditioner, the setting of the set temperature is carried out by each of plural indoor units to which respective operating devices are connected, and required power of each indoor unit determined on the basis of the set temperature and the room temperature is transmitted to an outdoor unit through data communication, and the outdoor unit drives a compressor with the driving power corresponding to the required power from each indoor unit.

In the construction of the air conditioner described above, the relationship between an analog value indicating the rotational position of the temperature adjusting dial and the set temperature set on the basis of the analog value is fixed to one-to-one correspondence relationship, and when the operable temperature range of each indoor unit is varied in accordance with the operation mode, for example when it is set to the range from 18° C. to 30° C. under cooling operation and also set to the range from 16° C. to 26° C. under heating operation, the variable range of the set temperature corresponding to the variable range of the analog value is set to the range from 16° to 30° C., that is, the range from the minimum temperature to the maximum temperature of all the operation modes.

However, if the variable range of the set temperature is set to the range from the minimum temperature to the maximum temperature of all the operation modes, an unchangeable range in which the set temperature is not changeable because the set temperature is out of the set temperature range to which the indoor unit is adaptable even when the temperature adjusting dial is operated occurs every operation mode. For example, when the operable temperature range under cooling operation is from 18° C. to 30° C., the set temperature is fixed to 18° and unchangeable from this temperature even when the temperature adjusting dial is operated to the position corresponding to the temperature from 16° C. to 18° C. Furthermore, when the operable temperature range under heating operation is from 16° C. to 26° C., the set temperature is fixed to 26° C. and unchangeable from this temperature even when the temperature adjusting dial is operated to the position corresponding to the temperature from 26° C. to 30° C.

As described above, when the unchangeable range in which the set temperature is unchangeable occurs, an operation range which can be allocated every set temperature is narrowed by the amount corresponding to the unchangeable range, and thus the frequency at which the temperature adjusting dial is located at a set temperature switching point is increased. In this case, when the temperature adjusting dial is located at a set temperature switching point, the set temperature concerned is repetitively changed between the temperatures before and after the switching point irrespective of the non-operation of the temperature adjusting dial, and thus the transmission processing of the required power is frequently executed in accordance with the change of the set temperature, so that the communication line between the indoor unit and the outdoor unit is congested.

Furthermore, the operable temperature range of the indoor unit is also varied in accordance with the type of the indoor unit. When the set temperatures satisfying the operable temperature ranges of these types are allocated within the operation range of the temperature adjusting dial in order to adapt to all the types as described above, there occurs an unchangeable range in which the set temperature is unchangeable even when the temperature adjusting dial is operated, resulting in occurrence of the congestion of the communication line.

SUMMARY OF THE INVENTION

Therefore, an object of the present invention is to provide an air conditioner that can eliminate an unchangeable range in which set temperature is unchangeable despite variation in the operation mode or the type of the air conditioner even when an analog operating member is operated, a method of controlling the air conditioner, a temperature setting device for the air conditioner, and a method of controlling the temperature setting device.

In order to attain the above object, according to a first aspect of the present invention, there is provided an air conditioner including an outdoor unit and at least one indoor unit comprising: an operating device provided to the indoor unit, the operating device being equipped with an analog operating member for setting a set temperature of the indoor unit and outputting an indication value that is associated with the set temperature and continuously varies in accordance with an operation of the analog operating member; and a set temperature adjusting unit for changing a variable range of the set temperature corresponding to a variable range of the indication value on the basis of at least one of an operation mode of the indoor unit and the type of the indoor unit.

According to the above construction, the variable range of the set temperature corresponding to the variable range of the indication value continuously varying in accordance with the operation of the analog operating member can be changed on the basis of at least one of the operation mode of the indoor unit and the type of the indoor unit. Therefore, an unchangeable range in which the set temperature is not changed even when the analog operating member is operated can be eliminated.

In the above construction, the set temperature adjusting unit may make the variable range of the set temperature corresponding to the variable range of the indication value substantially coincident with an operable temperature range of the indoor unit.

In the above construction, the set temperature adjusting unit may set the lower limit temperature of the operable temperature range of the present operation mode of the indoor unit as the set temperature when the indication value is the minimum value, and set the upper limit temperature of the operable temperature range of the present operation mode of the indoor unit as the set temperature.

In the above construction, the set temperature adjusting unit may convert the indication value to the corresponding set temperature according to a conversion rule in which the correlation between the indication value and the set temperature has a linear characteristic.

In the above construction, the set temperature setting unit may be equipped with a communication unit for transmitting a set temperature set on the basis of the indication value to the indoor unit at a time interval, and a transmission cancel unit for monitoring a variation amount of the set temperature and canceling transmission of the set temperature from the communication unit when the variation amount of the set temperature is equal to a predetermined set value or less.

According to the above construction, when the variation amount of the set temperature is not more than the predetermined set value, the transmission of the set temperature is canceled and thus there can be avoided such a case that the set temperature is transmitted under the state that the analog operating member is kept to be stopped at the set temperature switching point. Therefore, the congestion of the communication line between the indoor unit and the outdoor unit can be avoided.

In the above construction, the transmission cancel unit may further monitor at least one of whether a predetermined set time has not yet elapsed from the setting time of the set temperature and whether the operation mode is changed or not, and cancel the transmission of the set temperature from the communication unit when the predetermined time has not yet elapsed or the operation mode is unchanged, and also when the variation amount of the set temperature is equal to the predetermined set value or less.

In the above construction, the analog operating member may be a temperature adjusting dial.

According to a second aspect of the present invention, there is provided a method of controlling an air conditioner including an outdoor unit and at least one indoor unit equipped with an operating device for outputting an indication value varying continuously in accordance with an operation of an analog operating member, comprising the steps of: setting a set temperature of the indoor unit on the basis of the indication value of the operating device; and changing a variable range of the set temperature corresponding to a variable range of the indication value on the basis of at least one of the operation mode of the indoor unit and the type of the indoor unit.

According to the above method, the variable range of the set temperature corresponding to the variable range of the indication value can be changed on the basis of at least one of the operation mode of the indoor unit and the type of the indoor unit, and thus the unchangeable range in which the set temperature is not changed even when the analog operating member is operated can be eliminated.

According to a third aspect of the present invention, there is provided a temperature setting device for setting a set temperature of equipment comprising: an operating device equipped with an analog operating member for setting a set temperature of the indoor unit, the operating device outputting an indication value that is associated with the set temperature and continuously varies in accordance with an operation of the analog operating member; and a set temperature adjusting unit for changing a variable range of the set temperature corresponding to a variable range of the indication value on the basis of at least one of an operation mode of the equipment connected to the temperature setting device and the type of the equipment.

According to the above construction, the variable range of the set temperature corresponding to the variable range of the indication value that continuously varies in accordance with the operation of the analog operating member can be changed on the basis of at least one of the operation mode of the connected equipment and the type of the connected equipment, and thus the unchangeable range in which the set temperature is not changed even when the analog operating member is operated can be eliminated.

According to a fourth aspect of the present invention, there is provided a method of controlling a temperature setting device equipped with an operating device for outputting an indication value varying continuously in accordance with an operation of an analog operating member, comprising the steps of: setting a set temperature of equipment on the basis of the indication value of the operating device; and changing a variable range of the set temperature corresponding to a variable range of the indication value on the basis of at least one of the operation mode of the equipment connected to the temperature setting device and the type of the equipment.

According to the above method, the variable range of the set temperature corresponding to the variable range of the indication value can be changed on the basis of at least one of the operation mode of the connected equipment and the type of the connected equipment, and thus the unchangeable range in which the set temperature is not changed even when the analog operating member is operated can be eliminated.

According to the present invention, the variable range of the set temperature corresponding to the variable range of the indication value that continuously varies in accordance with the operation of the analog operating member can be changed on the basis of at least one of the operation mode of the connected equipment and the type of the connected equipment, and thus the unchangeable range in which the set temperature is not changed even when the analog operating member is operated can be eliminated even when the operation mode or the type of the equipment (indoor unit) is changed.

BRIEF DESCRIPTION OF THE DRAWINGS

FIG. 4 is a diagram showing table data;

FIG. 7 is a diagram showing table data according to a modification.

DETAILED DESCRIPTION OF THE PREFERRED EMBODIMENTS

Preferred embodiments according to the present invention will be described hereunder with reference to the accompanying drawings.

Figure 1:
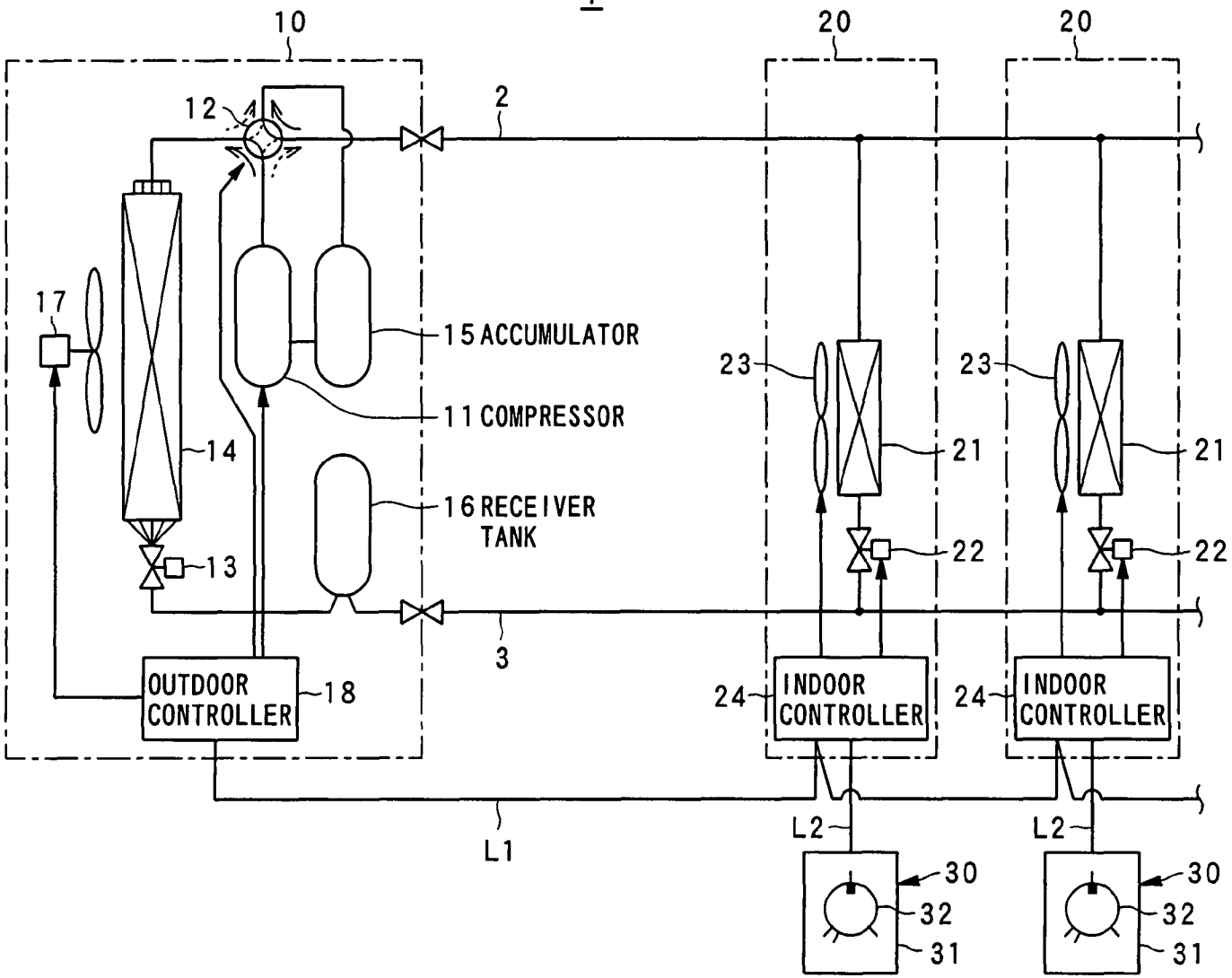
FIG. 1 is a diagram showing the construction of an air conditioner according to an embodiment according to the present invention.

FIG. 1 is a diagram showing the construction of an air conditioner 1 according to an embodiment of the present invention. The air conditioner 1 is set up in a building having plural rooms to be air-conditioned such as a hotel or the like, for example, and it comprises one outdoor unit 10, plural indoor units 20 set up in the respective rooms to be air-conditioned, and a refrigerant pipe comprising inter-unit pipes 2 and 3.

The outdoor unit 10 is set up outdoors. The outdoor unit 10 comprises a compressor 11 for compressing refrigerant, a four-way valve 12 for reversing the circulating direction of the refrigerant, an outdoor heat exchanger 13 for heat-exchanging the refrigerant with outdoor air, an outdoor expansion valve 14 for reducing the pressure of the refrigerant, an accumulator 15, and a receiver tank 16 which are connected to one another through a pipe, and also it further comprises an outdoor air blower 17 for blowing the outdoor air to the outdoor heat exchanger 13, and an outdoor controller 18 for controlling the above elements.

The indoor unit 20 is set up on the ceiling, wall or the like of a room to be air-conditioned. The indoor unit 20 comprises an indoor heat exchanger 21 and an indoor expansion valve 22 which are connected to each other through a pipe, and it further comprises an indoor air blower 23 for blowing indoor air to the indoor heat exchanger 21, and an indoor controller 24 for controlling the indoor expansion valve 22 and the indoor air blower 23. The outdoor controller 18 and the indoor controller 24 are connected to each other through a communication line L1 so that data communications can be performed therebetween, and an operating device (temperature setting device) 30 is connected to the indoor controller 24 through a communication line L2.

In the above-described air conditioner 1, the four-way is switched so that the refrigerant flows in the direction of an arrow of solid line, whereby the outdoor heat exchanger 13 is made to function as a condenser and the indoor heat exchanger 21 is made to function as an evaporator to carry out cooling operation and dry operation. In addition, the four-way is switched so that the refrigerant flows in the direction of an arrow of dashed line, whereby the outdoor heat exchanger 13 is made to function as an evaporator and the indoor heat exchanger 21 is made to function as a condenser to carry out heating operation.

Figure 2:
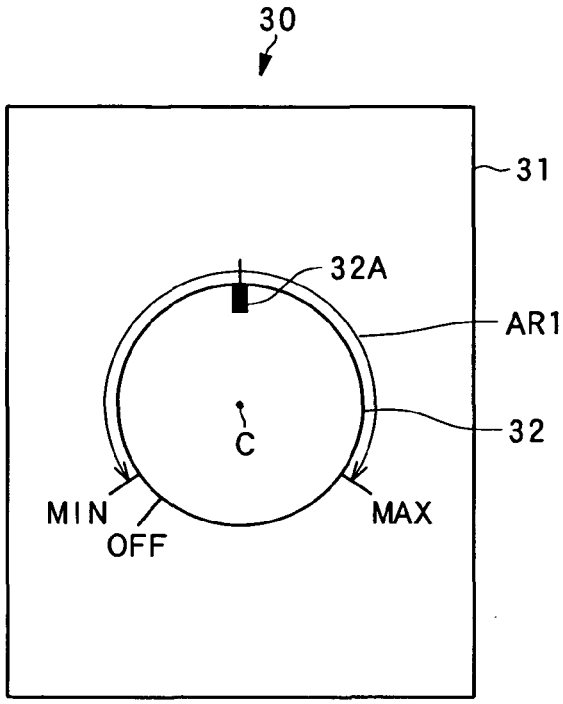
FIG. 2 is a diagram showing an appearance of an operating device.
Figure 3:
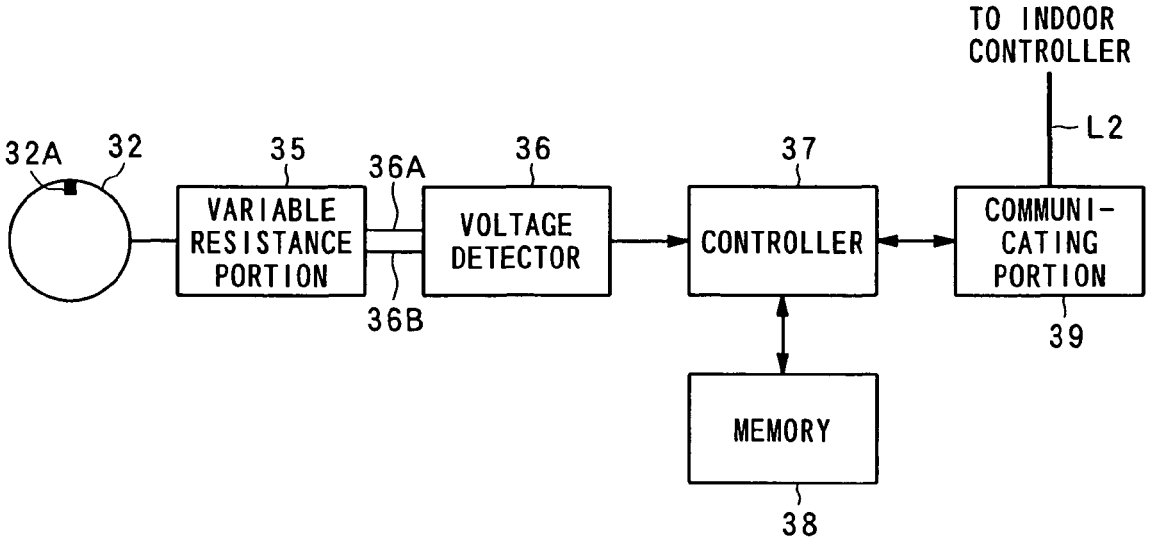
FIG. 3 is a diagram showing an electrical construction of the operating device.

FIG. 2 is a diagram showing the outer appearance of the operating device 30, and FIG. 3 is a diagram showing the electrical construction of the operating device 30. The operating device 30 is a device for notifying the set temperature to the indoor controller 24, and it comprises a setup panel 31 for setting up the operating device 30 itself on the wall of the room to be air-conditioned, and a temperature adjusting dial 32 mounted on the setup panel 31 through a variable-resistance portion 35 (FIG. 2) so as to be freely rotatable around the center C thereof. Here, the variable resistance portion 35 is fixed to a circuit board (not shown) fixed to the setup panel 31, and the resistance value is variable in accordance with the rotational operation of the temperature adjusting dial 32.

The setup panel 31 are marked with calibrations containing "OFF" indicating the operation stop instructing position of the indoor unit 20, "MIN" indicating the lower limit position of the resistance adjustable range of the variable resistance portion 35, "MAX" indicating the upper limit value, etc. Furthermore, an index portion 32A is marked on the temperature adjusting dial 32, and the range from "OFF" to "MAX" in which the index portion 32A indicates is restricted to the operable range of the temperature adjusting dial 32.

Furthermore, the range AR1 from "MIN" to "MAX" indicated by the index portion 32A of the temperature adjusting dial 32 corresponds to the variable range in which the resistance value of the variable resistance portion 35 is continuously variable. At the position where the index portion 32A is set to indicate "OFF", the variable resistance portion 35 is set to an operation stop instruction state which is allocated to the variable resistance portion 35. For example, in the above construction, under this state, electrical wires 36A and 36B are kept to be disconnected to each other.

In addition to the variable resistance portion 35, a voltage detector 36, a controller (set voltage adjusting means) 37, a memory 38 and a communicating portion 39 are provided on the circuit board of the operating device 30 as shown in FIG. 3. The voltage detector 36 is connected to the variable resistance portion 35 through two electrical wires 36A and 36B. One of the electrical wires is supplied with current to generate the voltage corresponding to the resistance value of the variable resistor portion 35, and the voltage occurring between the electrical wires 36A and 36B is detected to thereby detect a voltage value (indicated value) V1 which is continuously varied in accordance with the operation of the temperature adjusting dial 32. Accordingly, the voltage detector 36 functions as an operation detecting unit for detecting the operation of the temperature adjusting dial 32. In this embodiment, the operating device is designed so that when the index portion 32A of the temperature adjusting dial 32 is moved within the range AR1, the voltage value V1 is set to continuously vary between 0V and 10V.

The controller 37 controls each of the parts of the operating device 30, and it reads out various kinds of data such as program data, etc. stored in the memory 38 and carries out conversion processing of converting the voltage value (indicated value) V1 detected by the voltage detector 36 to a set temperature TS, communication processing, etc. Furthermore, the communicating portion 39 carries out data communications with the indoor controller 24 through the communication line L2 under the control of the controller 37.

In this construction, table data D1 indicating the operable temperature range of each operation mode of the indoor unit 20 are stored in a non-volatile memory of the indoor controller 24. More specifically, the upper limit value Ak (k=1 to 4) and the lower limit value (k=1 to 4) of the operable temperature range of each of all the operation modes (cooling operation, heating operation, dry operation, cooling/heating automatic operation) of the indoor unit 20 are stored in the table data D1 as shown in FIG. 4.

Figure 5:
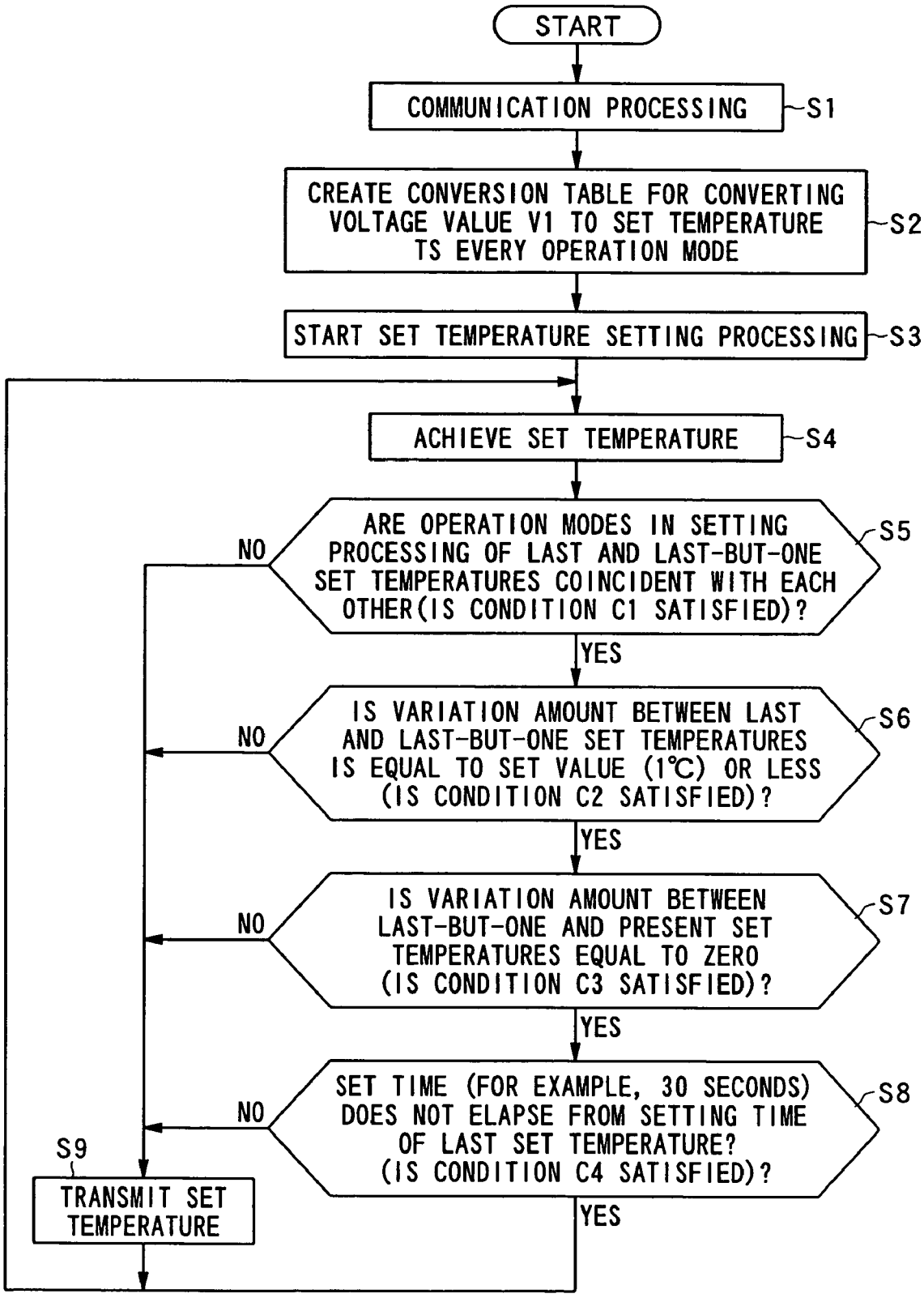
FIG. 5 is a flowchart showing the operation of the operating device.

Next, the operation of the operating device 30 will be described. FIG. 5 is a flowchart showing the operation of the operating device 30. When a power-on operation is carried out in this operating device 30, that is, the temperature adjusting dial 32 is rotated from the "OFF" position to another position "any position in the range AR1 between "MIN" and "MAX"), the controller 37 detects the operation concerned through the voltage value V1 notified from the voltage detector 36 and communicates with the indoor controller 24 (step S1).

When the communication (initial communication) is carried out after the power-on operation described above, the controller 37 requests the information of the operable temperature of each operation mode of the indoor unit 20 to the indoor controller 24, and achieves the information of the upper limit value AK and the lower limit value Bk of the operable temperature of each operation mode described in the table data D1 stored in the non-volatile memory of the indoor controller 24.

Subsequently, on the basis of the thus-achieved information, the controller 37 creates a conversion table for converting the voltage value V1 detected by the voltage detector 336 to the corresponding set temperature TS every operation mode (step S2). This conversion table is a conversion table for setting the variable range of the voltage V1 to the operable temperature range of each operation mode. For example, when the operable temperature range under cooling operation is from the lower limit value 18° C. to the upper limit value 30° C., a conversion table having the correlation between the voltage value V1 and the set temperature TS shown in FIG.

Figure 6A:
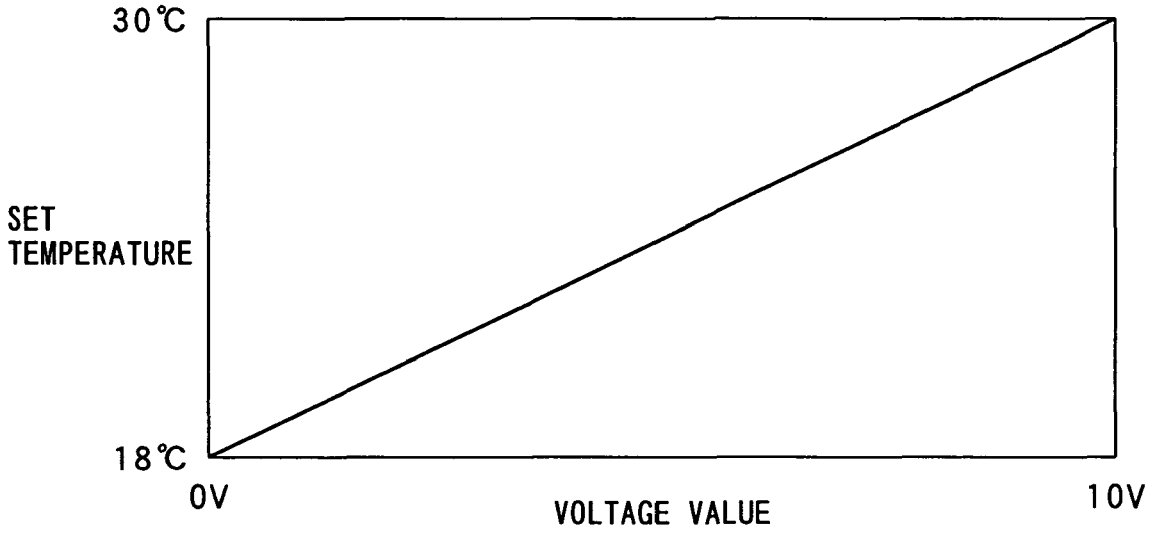
FIG. 6A is a diagram showing an example of the correlation between the voltage value and the set temperature under cooling operation.
Figure 6B:
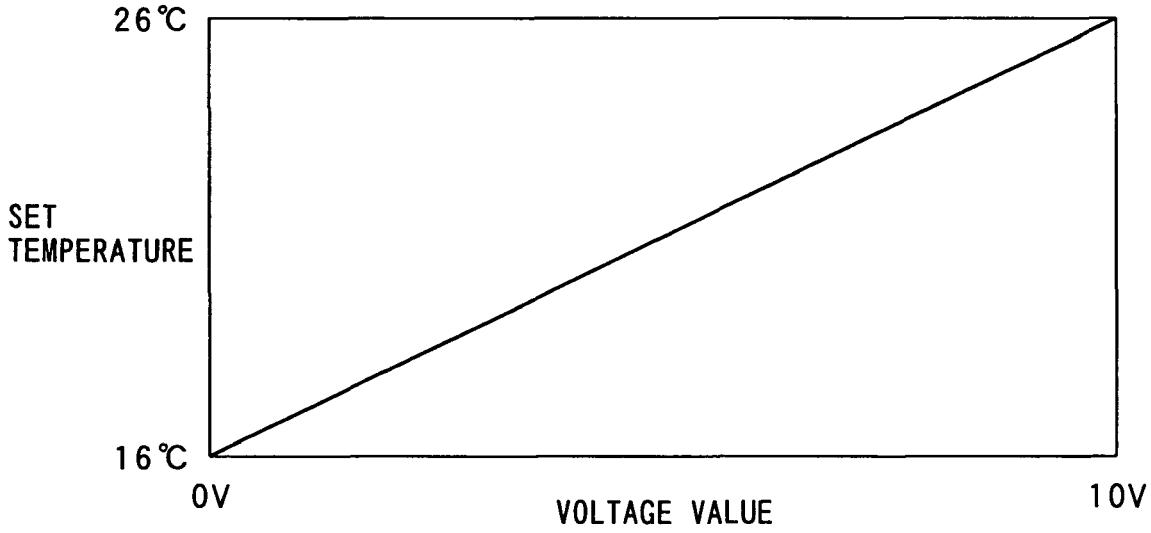
FIG. 6B is a diagram showing an example of the correlation between the voltage value and the set temperature under heating operation.

6A is created. In the conversion table concerned, the minimum value 0V of the voltage value V1 is set to correspond to the lower limit temperature 18° C. of the cooling operation, the maximum value 10V of the voltage value V1 is set to correspond to the upper limit temperature 30° C. of the cooling operation and the other values of the voltage value V1 other than the above values are equally shared to the respective operable temperatures of the cooling operation. When the operable temperature range under heating operation is from the lower value of 16° C. to the upper limit value 26° C., there is created a conversion table for setting the variable range of the set temperature TS corresponding to the variable range of the voltage value V1 to the range from 16° C. to 26° C. as shown in FIG. 6B.

That is, according to the above construction, a conversion table having such a conversion rule that the variable range of the set temperature TS corresponding to the variable range of the voltage value V1 is substantially coincident with the operable temperature range inherent to the operation mode and the correlation between the voltage value V1 and the set temperature TS has a linear characteristic is created every operation mode. The present invention is not limited to the above method of creating the table data associating the voltage value V1 and the set temperature TS as the conversion table, but the conversion table may be calculated by using a calculation method for calculating the set temperature TS from the voltage value V1.

The controller 37 judges at a predetermined time interval which one of cooling operation, heating operation, dry operation and cooling/heating automatic operation the present operation mode corresponds to, and the controller 37 starts the set temperature setting processing for setting the set temperature TS from the voltage value V1 by using the conversion table corresponding to the present operation mode (step S3). In this set temperature setting processing, when change of the operation mode is detected, the present conversion table is switched to the conversion table corresponding to the operation mode after the change of the operation mode, and the processing described above is executed by using the conversion table adapted to the present operation mode at all times.

In this set temperature setting processing, the controller 37 carries out the processing of detecting the voltage value V1 every 5 msec, truncating the maximum and minimum values from these detected voltage values after the voltage value V1 is detected ten times, calculating the average value V1A the residual eight detected voltage values and setting the set temperature TS from the average value V1A by using the conversion table. The controller 37 carries out the above processing ten times, and if the same set temperature TS is detected at at least eight times out of the ten times in the above ten-times processing, the controller 37 judges that the value is valid. That is, the controller 37 sets an effective set temperature TS once per 500 milliseconds at earliest.

The set temperature thus set is successively stored in the memory 38, and at least the last (just preceding) set temperature TS and the last-but-one set temperature TS are held in the memory 38 at all times. In the following description, the last (just preceding) set temperature TS is represented by TS-1, the last-but-one set temperature TS is represented by TS-2, and the present set temperature TS is represented by TS-0 for the sake of convenience of description.

Next, when the controller 37 achieves the set temperature TS-0 judged as being valid (step S4), the controller 37 executes the transmission judging processing as to whether the set temperature TS-0 should be transmitted to the indoor controller 24 (steps S5 to S8). Described in more detail, the controller 37 first judges whether the operation mode in the set temperature setting processing of the last set temperature is coincident with the operation mode in the set temperature setting processing of the last-but-one set temperature (a condition 1 is satisfied) or not (step S5). If the condition C1 is not satisfied, that is, the operation mode is changed (step S5: NO), the present set temperature TS-0 is transmitted to the indoor controller 24 by the communicating portion 39 (step S10), and then the processing shifts to the processing of step S4. Accordingly, after the operation mode is changed, the set temperature TS-0 is certainly transmitted to the indoor controller 24 for a while. Therefore, after the operation mode is changed, the information indicating the required power of the indoor unit concerned on the basis of the set temperature TS-0 achieved from the present rotational position of the temperature adjusting dial 32 and the indoor temperature is transmitted to the outdoor controller 18, and the outdoor controller 18 can rapidly operate the compressor 11 with the operation power satisfying the required power of the indoor unit 20.

On the other hand, if the condition C1 is satisfied, that is, the operation mode is unchanged (step S5: YES), the controller 37 judges whether the variation amount between the last set temperature TS-1 and the last-but-one set temperature TS-2 is equal to a set value (1° C.) or less (a condition C2 is satisfied) (step S6). If the controller 37 judges that the condition C2 is not satisfied, the controller 37 can judge that a user is operating the temperature adjusting dial 32, and thus shifts the processing to step S9 to transmit the present set temperature TS-0 to the indoor controller 24. On the other hand, if it is judged that the condition C2 is satisfied, the controller 37 judges whether the variation amount between the last-but-one set temperature TS-2 and the present set temperature TS-0 is equal to zero (a condition C3 is satisfied) (step S7).

Here, when the condition C3 is not satisfied (step S7: NO), the controller 376 judges that the user is operating the temperature adjusting dial 32, and thus the controller 37 shifts the processing to step S9 to transmit the present set temperature TS-0 to the indoor controller 24. On the other hand, if the condition C3 is satisfied (step S7: YES), it is judged whether a predetermined set time (for example, 30 seconds) does not elapse from the setting time of the last set temperature (a condition C4 is satisfied) (step S8).

If the controller 37 judges that the condition C4 is not satisfied (step S8: NO), the controller 37 shifts the processing to step S9 to transmit the present set temperature TS-0 to the indoor controller 24 and then shifts the processing to step S3. On the other hand, if the controller 37 judges that the condition c4 is satisfied (step S8: YES), the controller 37 shifts the processing to step S4, so that the controller 37 newly executes the set temperature setting processing without transmitting the present set temperature TS-0 to the indoor controller 24. That is, when the controller 37 judges that all the conditions C1 to C4 are satisfied, the controller 37 functions as a transmission cancel unit for ceasing the transmission processing of the present set temperature TS-0, and thus canceling the transmission of the set temperature. The foregoing operation is the operation of the operating device 30.

In this construction, the operating device 10 achieves the information of the operable temperature of each operation mode of the indoor unit by communicating with the indoor control device 24, and on the basis of the information concerned the operating device 10 creates a conversion table for each operation mode in which the variable range of the set temperature TS corresponding to the variable range of the voltage value V1 indicating the operation of the operating device 10 is made substantially coincident with the operable temperature range of each operation mode. Therefore, the variable range of the set temperature TS corresponding to the variable range of the voltage value V1 can be changed in accordance with the operation mode. Therefore, any unchangeable range in which the set temperature is not changeable even when the temperature adjusting dial 32 is operated can be eliminated, and thus each operation range allocated every set temperature can be broadened. Accordingly, the frequency at which the temperature adjusting dial 32 is located at a set temperature switching point can be reduced.

Furthermore, in the above construction, the operating device 10 cancels the transmission of the set temperature TS-0 when the following four conditions C1 to C4 are satisfied: the operation mode under the setting processing of the last set temperature and the operation mode under the setting processing of the last-but-one set temperature are coincident with each other (the condition 1); the variation amount between the last set temperature TS-1 and the last-but-one set temperature TS-2 is equal to the set value (1° C.) or less (the condition C2); the variation amount between the last-but-one set temperature TS-2 and the present set temperature TS-0 is equal to zero (the condition C3); and a predetermined set time (for example, 30 seconds) has not yet elapsed from the setting time of the last set temperature (the condition C4). Therefore, the set temperature is not transmitted when the operation mode is unchanged, the variation amount of the set temperature is not more than the predetermined value and also the set time has not yet elapsed from the setting time of the last set temperature.

Here, the state where the variation amount of the set temperature is not more than predetermined value corresponds to a case where the temperature adjusting dial 32 is kept to be stopped at a position other than the set temperature switching points and the variation amount of the set temperature is equal to zero or a case where the temperature adjusting dial is kept to be stopped at a set temperature switching point and the set temperature is repetitively changed between the temperatures before and after the set temperature switching points (for example, 24° C.→25° C.→24° C.→, . . . ). In this construction, under the above state, the set temperature is not transmitted until the operation mode is changed or the predetermined time (30 seconds) elapses from the time when the last set temperature is set, so that the transmission frequency of the set temperature can be reduced.

In this case, when it is assumed that the set temperature is transmitted under the state that the temperature adjusting dial 32 is kept to be stopped at the set temperature switching point, the set temperature frequently varies within the range of 1° C. and thus this variation of the set temperature is treated as a variation of the required power in the indoor controller 24. Therefore, the communication amount between the indoor unit 20 and the outdoor unit 10 is increased, which causes congestion of the communication lines among the outdoor unit 10 and the plural indoor units 20. On the other hand, according to the construction of the present invention, under the above state the transmission interval of the set temperature is increased, and thus the congestion of the communication lines among the outdoor unit 10 and the plural indoor units 20 can be avoided.

The present invention is not limited to the above-described embodiment. For example, in the above-described embodiment, when the four conditions C1 to C4 are satisfied, the transmission of the set temperature is canceled. However, the transmission of the set temperature may be canceled at least under the state that the temperature adjusting dial is set so that the set temperature is kept to be stopped at a switching point, and for example when the variation amount of the set temperature is not more than a predetermined value (for example, 1° C. or less), the transmission of the set temperature may be canceled at all times, or the above condition may be suitably changed.

Furthermore, in the above embodiment, the information indicating the operable temperature range of each operation mode for each of plural types of indoor units 20 (for example, a four-way cassette type, a built-in cassette type, etc.) may be stored in the table data D1 as shown in FIG. 7. In this case, the operating device 30 specifies the type of the indoor unit 20 by communicating with the indoor controller 24, and creates the conversion table corresponding to the specified type. According to this construction, the operating device 30 may be commonly used for an air conditioner having different types of indoor units 20 or an air conditioner in which different indoor units 20 are mixed.

Furthermore, in the above-described embodiment, the table data D1 indicating the operable temperature range of each operation mode of the indoor unit 20 is stored in the non-volatile memory of the indoor controller 24. However, the table data D1 may be stored in the memory 38 of the operating device 30. Furthermore, in the above embodiment, the voltage V1 varying continuously in accordance with the operation of the temperature adjusting dial 32 is detected. However, the resistance value varying continuously in accordance with the operation of the temperature adjusting dial 32 may be detected. Furthermore, a rotation detector for detecting the rotational position of the temperature adjusting dial 32 may be provided so that the rotational position of the temperature adjusting dial is directly detected through the rotation detector. Still furthermore, in place of the temperature adjusting dial 32, another type of analog operating member which can carry out an analog operation may be applied.

In the above-described embodiment, the present invention is applied to the operating device of the air conditioner. However, the operating device of the present invention may be broadly applied to a temperature setting device used for general refrigerating apparatuses such as a gas heat pump type air conditioner, an absorption type refrigerating machine, a refrigerator, an automatic dispenser, a showcase, etc.

What is claimed is:

1. An air conditioner including at least one indoor unit comprising:

an operating device provided to the indoor unit, the operating device being equipped with an analog operating member for setting a set temperature of the indoor unit within an operation range of the analog operation member and outputting an indication value that is associated with the set temperature; and a set temperature adjusting unit for defining a relationship between a variable range of the indication value that corresponds to an operation of the analog operating member and a variable range of the set temperature on the basis of operable temperature information of the indoor unit and changing the variable range of the set temperature on the basis of the relationship, the operable temperature information being varied in accordance with at least one of an operation mode of the indoor unit and a type of the indoor unit.

2. The air conditioner according to claim 1, wherein the set temperature adjusting unit makes the variable range of the set temperature corresponding to the variable range of the indication value substantially coincident with an operable temperature range of the indoor unit.

3. The air conditioner according to claim 2, wherein the set temperature adjusting unit converts the indication value to the corresponding set temperature according to a conversion rule in which the correlation between the indication value and the set temperature has a linear characteristic.

4. The air conditioner according to claim 1, wherein the set temperature adjusting unit sets the lower limit temperature of the operable temperature range of the present operation mode of the indoor unit as the set temperature when the indication value is the minimum value, and sets the upper limit temperature of the operable temperature range of the present operation mode of the indoor unit as the set temperature.

5. The air conditioner according to claim 4, wherein the set temperature adjusting unit converts the indication value to the corresponding set temperature according to a conversion rule in which the correlation between the indication value and the set temperature has a linear characteristic.

6. The air conditioner according to claim 1, wherein the set temperature adjusting unit comprises:

a communication unit for transmitting a set temperature set on the basis of the indication value to the indoor unit at a time interval; and a transmission cancel unit for monitoring a variation amount of the set temperature and for canceling transmission of the set temperature from the communication unit when the variation amount of the set temperature is equal to a predetermined set value or less.

7. The air conditioner according to claim 6, wherein the transmission cancel unit further monitors at least one of whether a predetermined set time has not yet elapsed from the setting time of the set temperature and whether the operation mode is changed or not, and cancels the transmission of the set temperature from the communication unit when the predetermined time has not yet elapsed or the operation mode is unchanged, and also when the variation amount of the set temperature is equal to the predetermined set value or less.

8. The air conditioner according to claim 1, wherein the analog operating member is a temperature adjusting dial.

9. A method of controlling an air conditioner including at least one indoor unit equipped with an operating device for outputting an indication value varying in accordance with an operation of an analog operating member, comprising the steps of:

setting a set temperature of the indoor unit within an operation range of the analog operation member on the basis of the indication value of the operating device; and defining a relationship between a variable range of the indication value that corresponds to the operation of the analog operating member and a variable range of the set temperature on the basis of operable temperature information of the indoor unit and changing the variable range of the set temperature on the basis of the relationship, the operable temperature information being varied in accordance with at least one of an operation mode of the indoor unit and a type of the indoor unit.

10. A temperature setting device for setting a set temperature of equipment comprising:

an operating device equipped with an analog operating member for setting a set temperature of an indoor unit within an operation range of the analog operation member, the operating device outputting an indication value that is associated with the set temperature; and a set temperature adjusting unit for defining a relationship between a variable range of the indication value that corresponds to an operation of the analog operating member and a variable range of the set temperature on the basis of operable temperature information of the equipment and changing the variable range of the set temperature on the basis of the relationship, the operable temperature information being varied in accordance with at least one of an operation mode of the equipment connected to the temperature setting device and a type of the equipment.

11. A method of controlling a temperature setting device equipped with an operating device for outputting an indication value varying in accordance with an operation of an analog operating member, comprising the steps of:

setting a set temperature of equipment within an operation range on the basis of the indication value of the operating device; and defining a relationship between a variable range of the indication value that corresponds to the operation of the analog operating member and a variable range of the set temperature on the basis of operable temperature information of the equipment and changing the variable range of the set temperature on the basis of the relationship, the operable temperature information being varied in accordance with at least one of an operation mode of the equipment connected to the temperature setting device and a type of the equipment.

* * * * *